United States Patent [19]

Flanagan

[11] 4,120,708

[45] Oct. 17, 1978

[54] NONMETALLIZED SOLID FLUORINE OXIDIZER GAS GENERATOR

[75] Inventor: Joseph E. Flanagan, Woodland Hills, Calif.

[73] Assignee: Rockwell International Corporation, El Segundo, Calif.

[21] Appl. No.: 877,446

[22] Filed: Feb. 13, 1978

Related U.S. Application Data

[63] Continuation-in-part of Ser. No. 732,243, Oct. 14, 1976, abandoned.

[51] Int. Cl.[2] ..... C06B 45/08

[52] U.S. Cl. ..... 149/17; 149/19.3; 149/20; 149/35; 149/119

[58] Field of Search ..... 149/17, 19.3, 20, 35, 149/119

[56] References Cited

U.S. PATENT DOCUMENTS

| | | | |
|---|---|---|---|
| 3,708,570 | 1/1973 | Tolberg et al. | 149/119 |
| 3,833,432 | 9/1974 | Moy et al. | 149/35 |
| 3,980,509 | 9/1976 | Lubowitz et al. | 149/19.3 |
| 4,001,136 | 1/1977 | Channell et al. | 149/19.3 |
| 4,003,771 | 1/1977 | Lubowitz | 149/17 |

OTHER PUBLICATIONS

Criste et al., Inorganic Chemistry, 15 (No. 6), pp. 1275–1282 (1976).

*Primary Examiner*—Edward A. Miller

*Attorney, Agent, or Firm*—L. Lee Humphries; Robert M. Sperry

[57] ABSTRACT

A solid laser oxidizer source suitable for use in a HF or DF chemical laser.

1 Claim, No Drawings

NONMETALLIZED SOLID FLUORINE OXIDIZER GAS GENERATOR

CROSS REFERENCE TO RELATED APPLICATIONS

This application is a continuation-in-part of application Ser. No. 732,243 filed Oct. 14, 1976 and abandoned.

BACKGROUND OF THE INVENTION

1. Field of the Invention

This invention relates to solid propellant gas generators and is particularly directed to solid propellant fluorine gas generators formed from phosphorus containing fluoride compounds.

2. Description of Prior Art

From U.S. Pat. Nos. 3,963,542; 3,980,509 and 4,003,771 it is learned that solid propellants which produce fluorine atoms have been formulated. However, these solid propellants suffer from two drawbacks. In U.S. Pat. No. 3,963,542 high molecular weight gases ($BF_3$ and $CF_4$) are generated which have an adverse gasdynamic effect on the performance of chemical lasers.

In U.S. Pat. Nos. 3,980,509 and 4,003,771 alkali metal fluoride sequestering agents are employed to eliminate the high molecular weight gaseous fluorides, and metallic additives are employed as fuels. Both of these methods result in a decreased yield of the desired gaseous products.

BRIEF SUMMARY AND OBJECTS OF THE INVENTION

According to the invention, solid propellant grain compositions are provided which will produce $F_2$, $NF_3$, and $N_2$. The invention allows for the tailoring of the ratio of nitrogen to fluorine molecules which is important to the operation of a chemical laser in that no additional diluent source would be required for satisfactory gasdynamic performance.

The invention also allows for the complete elimination of metallic augmenting fuels such as Mg, Al, B, AlN, and $Mg_3N_2$ which often lead to friction sensitivity problems. Sodium azide or sodium nitride are used as fuels, sequestering agents, and nitrogen sources simultaneously. The nitrogen level is adjusted by varying the ratio of sodium azide to sodium nitride.

Polyphosphonitride polymers of the formula $(NPF_2)_n$ are employed to improve the physical properties of the propellant. The $PF_5$ gas generated is complexed by the sodium atoms from sodium azide and sodium nitride to form $NaPF_6$.

The oxidizing salt $NF_4PF_6$ is used as the primary source of fluorine and nitrogen trifluoride gases. A typical reaction can be illustrated by the equation:

$$\left[\begin{array}{c}NaN_3\\ \text{and/or}\\ Na_3N\end{array}\right] + \underset{\text{(excess)}}{NF_4PF_6 + PF_2N} \longrightarrow \underbrace{NF_3 + F_2 + N_2}_{\text{Gases}} + \underbrace{NaPF_6}_{\text{Solid Residue}}$$

Obviously, numerous variations and modifications may be made without departing from the present invention. Accordingly, it should be clearly understood that the forms of the present invention described above are illustrative only and are not intended to limit the scope of the present invention.

I claim:

1. A solid propellant composition for chemical laser applications comprising:

the fluorine oxidizing salt $NF_4PF_6$;

a material serving simultaneously as an augmenting fuel and sequestering agent, said material being selected from the group consisting of $NaN_3$, $Na_3N$ and mixtures thereof; and polyphosphonitrile as a polymer fuel.

* * * * *